US005803841A

United States Patent [19]

Daskoski

[11] Patent Number: 5,803,841

[45] Date of Patent: Sep. 8, 1998

[54] PITCHER'S TRAINING AID

[76] Inventor: Raymond S. Daskoski, R.R. 1, 4169 Drake Hill Rd., Albion, Me. 04910

[21] Appl. No.: 870,580

[22] Filed: May 21, 1997

Related U.S. Application Data

[60] Provisional application No. 60/019,643, Jun. 12, 1996.

[51] Int. Cl.[6] ..... A63B 69/38

[52] U.S. Cl. ..... 473/454

[58] Field of Search ..... 473/456, 421, 473/454, 417; 273/402, 410, 400, 401

[56] References Cited

U.S. PATENT DOCUMENTS

| | | | |
|---|---|---|---|
| 1,142,184 | 6/1915 | Lawrence | 473/454 |
| 1,592,005 | 7/1926 | Rovane | 473/454 |
| 2,628,097 | 2/1953 | Lecznar | 473/454 |
| 3,172,661 | 3/1965 | Scheemaker | 473/454 |
| 3,312,467 | 4/1967 | Dawson | 473/454 |
| 3,633,909 | 1/1972 | Doynow | 473/454 |
| 4,160,549 | 7/1979 | Simpson . | |
| 4,188,031 | 2/1980 | Fox | 473/454 |
| 4,210,326 | 7/1980 | Booth | 473/454 |
| 4,497,485 | 2/1985 | Macosko . | |
| 4,863,166 | 9/1989 | Becera | 473/454 |
| 4,883,272 | 11/1989 | Lay . | |
| 4,905,996 | 3/1990 | Tallent | 473/197 |
| 4,978,121 | 12/1990 | Larkey . | |
| 5,083,774 | 1/1992 | Yalvac . | |
| 5,242,160 | 9/1993 | Girard et al. . | |
| 5,333,856 | 8/1994 | Gery | 473/454 |
| 5,344,155 | 9/1994 | Huang . | |
| 5,348,291 | 9/1994 | Scully | 473/454 |
| 5,351,948 | 10/1994 | Thomas . | |
| 5,511,775 | 4/1996 | Parks . | |
| 5,516,115 | 5/1996 | McLain | 473/417 |
| 5,573,240 | 11/1996 | Humboldt | 473/454 |

FOREIGN PATENT DOCUMENTS

| | | |
|---|---|---|
| 397260 | 9/1933 | United Kingdom . |
| 642980 | 9/1950 | United Kingdom . |

*Primary Examiner*—Theatrice Brown
*Attorney, Agent, or Firm*—Richard C. Litman

[57] ABSTRACT

A practice device for baseball pitchers which allows the pitcher to adjust size and location of the strike zone for varying degrees of difficulty. The pitcher's training aid includes an upright rectangular frame structure made up of a horizontal base structure, a vertical target support structure, and at least one non-vertical brace member. Two horizontal support members are slidably mounted on the opposing vertical sides of the target support structure thereby defining the boundaries of a strike zone through which a ball may pass. The vertical height of the strike zone is adjusted by manipulating the positions of the two horizontal support members along the sides of the target support structure. The strike zone has a first net contiguously attached thereto to catch all the baseballs pitched within the strike zone.

The pitcher's training aid also includes a second net assembly which allows for adjustment of the width of the strike zone. The second net assembly has two elastic cords with hooks on each end and a net in between the two cords which can be attached to the horizontal support members. The pitcher's training aid includes two net pockets in which the baseball may enter; one that is within the strike zone (the first net) and one that is outside of the strike zone (the second net). Also, an integrated tape measure is provided for quickly and easily measuring and marking the distance from the frame to a practice pitcher's mound.

20 Claims, 5 Drawing Sheets

PITCHER'S TRAINING AID

CROSS-REFERENCE TO RELATED APPLICATION

This application claims the benefit of U.S. Provisional patent application Ser. No. 60/019,643, filed Jun. 12, 1996.

BACKGROUND OF THE INVENTION

1. Field of the Invention

The present invention relates to a practice device for baseball pitchers which allows the pitcher to adjust the size and location of the strike zone for varying degrees of difficulty.

2. Description of Related Art

In order to become a proficient softball or baseball pitcher, a player must practice for many hours. The traditional method of practicing pitching techniques requires both a pitcher and a catcher. But it may be difficult for a pitcher to find another player to practice with which severely limits when the pitcher can practice and for how much time she can practice. In addition, the traditional method of practicing pitching techniques lacks accuracy since it requires the catcher to make a subjective determination about whether or not the ball passed within the strike zone while at the same time attempting to catch a ball traveling at a high velocity. Accordingly, there is a need for a device which can allow a softball or baseball pitcher to practice pitching techniques without the aid of another player and can give the pitcher accurate feedback as to her proficiency level.

Both softball and baseball are played on a wide variety of levels, each with different rules about the size and position of the strike zone and the location of the pitching mound in relation to home plate. Leagues with young players have rules allowing a larger strike zone and shorter distance to the pitching mound than do leagues with professional players. Accordingly, there is a need for a device which allows the pitcher to practice throwing a ball through a target that simulates a variety of strike zones. The device should allow the pitcher to vary the size and height of the strike zone and it should allow the pitcher to measure and mark off the distance from the pitcher's mound to the target in order to simulate various league rules.

Once the pitcher's skills becomes more adept, the pitcher must practice not only pitching the ball within the strike zone, but also pitching the ball within a specific section of the strike zone. The pitcher may want to fine tune his or her skills by practicing throwing pitches that are low and inside. Consequently, there is a need for a device which will allow a pitcher to adjust the width and height of the strike zone so that he or she can fine tune his or her pitching skills.

In order to become a proficient softball or baseball batter, a player must also practice for many hours. One important skill of any good batter is knowing when a pitch is within the strike zone. There is a need for a device which can eliminate the subjective determination of whether or not a pitch is within the strike zone and thereby improve a batter's ability to determine when to swing at a pitch.

Due to the fact that the device will be used by players of all ages and that the players will likely be using the device alone, the device should be lightweight, yet sturdy. The device should also be collapsible for easy transportation and storage and should be easy to set up. The device should be free standing and capable of being set up either indoors or outdoors.

For the above reasons, pitching targets which allow a pitcher to practice throwing a ball within the strike zone have been proposed in the related art. However, none of the related art pitching targets achieve the versatility of the present invention.

U.S. Pat. No. 4,160,549, issued on Jul. 10, 1979, to John P. Simpson describes an adjustable target for practicing tennis serves including a substantially rectangular frame defining an enclosure through which the tennis balls may pass and a removable net to receive the tennis balls. The width of the frame may be partially adjusted and the overall height of the frame may also be adjusted. The structural design of the patent to Simpson does not allow for a large amount of width adjustment, as does the present invention. Nor does the patent to Simpson describe a device which is collapsible for easy transportation and storage. Furthermore, the patent to Simpson fails to describe a device for measuring the distance from the pitching target to the pitcher's mound.

U.S. Pat. No. 4,188,031, issued on Feb. 12, 1980, to Robert Z. Fox describes a multisport practice target that includes a base supporting a pair of laterally spaced apart upright posts with a net therebetween. The target has a pair of adjustable crossbar members which may be hung from hooks attached at intervals along the upright posts to define a variable height target area. One disadvantage of the device described in the patent to Fox is the fact that the net encircles the entire area defined by the upright posts, and it does not have a separate net for the target area as defined by the crossbars. By not incorporating a net solely to encompass the strike area it will be difficult for the player to determine from a distance whether the projectile went between the crossbars. In addition the patent to Fox fails to describe a device which is collapsible for easy transportation and storage. Furthermore, the patent to Fox fails to describe a device for measuring the distance from the pitching target to the pitcher's mound.

U.S. Pat. No. 4,497,485, issued on Feb. 5, 1985, to Robert L. Macosko describes a baseball pitching target with a compartmentalized ball receiving bag and a means for projecting balls that miss the strike zone back towards the pitcher. The patent to Macosko does not describe a device which can be adjusted to vary the size and position of the strike zone depending on the needs and ability level of the pitcher. Furthermore, the patent to Macosko describes a device which must be staked into the ground in order to be used and therefore cannot be set up and used indoors.

U.S. Pat. No. 4,883,272, issued on Nov. 28, 1989, to William C. Lay describes a multi-purpose pitching target and ball expelling apparatus. The patent to Lay does not describe a device which can be adjusted to vary the size and position of the strike zone.

U.S. Pat. No. 4,978,121, issued on Dec. 18, 1990, to Roger Larkey describes a portable pitching practice system including a target and a measuring cord for measuring the distance to the pitcher's mound. The patent to Larkey does not describe a device which can be adjusted to vary the size and position of the strike zone nor does it describe a device which is collapsible for easy transportation and storage.

U.S. Pat. No. 5,083,774, issued on Jan. 28, 1992, to Fikri Yalvac describes a baseball pitching target device with a pitching target area that is subdivided into specific strike zones. U.S. Pat. No. 5,242,160, issued on Sep. 7, 1993, to Thomas I. Girard et al. describes a portable backstop including a net for receiving and storing pitched balls. Neither of the patents describe a pitching target device with a strike zone that can be adjusted in height or width depending on the differences in league rules nor do they describe a device for measuring the distance from the pitching target to the pitcher's mound.

U.S. Pat. No. 5,333,856, issued on Aug. 2, 1994, to Jonathan S. Gery describes a vertical rectangular pitching practice target with a defined strike zone and a unit for obscuring part of the strike zone. The patent to Gery varies the height of the strike zone using resilient obscuring units which are attached to the backstop by hook and loop type fasteners. This method of varying the height of the strike zone is limited in that it requires a large number of different sized obscuring units in order to achieve the desired strike zone height and vertical positioning. The present invention can be adjusted to any level simply and without the need for numerous separate pieces. In addition, the resilient obscuring units are likely to flex when hit by a ball, thereby reducing the accuracy of the device, and they are likely to be pulled off of the backstop by the force of the ball if they are hit by a pitch. Furthermore, the patent to Gery does not describe a device which allows the pitcher to vary the width of the strike zone.

U.S. Pat. No. 5,344,155, issued on Sep. 6, 1994, to Jung-Feng Huang describes a projectile and target device. U.S. Pat. No. 5,351,948, issued on Oct. 4, 1994, to Roy J. Thomas describes a portable multi-sport ball receiving device with attachments for hitting and throwing. Neither of the patents describe a pitching target device with a strike zone that can be adjusted in height or width depending on the differences in league rules nor do they describe a device for measuring the distance from the pitching target to the pitcher's mound.

U.S. Pat. No. 5,511,775, issued on Apr. 30, 1996, to Alan D. Parks describes several different embodiments of a low rebound sports target useful in baseball pitching and fielding drills. A target is described which includes vertical chains and horizontal rods freely suspended from a frame in a spaced relation. One disadvantage of the device described in the patent to Parks is the fact that the net encircles the entire area defined by the upright posts, and it does not have a separate net for the target area as defined by the rods. By not incorporating a net solely to encompass the strike area it will be difficult for the player to determine from a distance whether the projectile went between the correct rods. In addition the patent to Parks fails to describe a device for measuring the distance from the pitching target to the pitcher's mound.

U.S. Pat. No. 5,516,115, issued on May 14, 1996, to Timothy J. McLain describes a portable practice target having a lightweight frame over which a net is slipped in a pillowcase-like manner. The patent to McLain does not describe a device which can be adjusted to vary the size and position of the strike zone. In addition the patent to McLain fails to describe a device for measuring the distance from the pitching target to the pitcher's mound.

British Patent Number 397,260, published on Aug. 24, 1933, describes an improved resilient sports net which rebounds objects thrown against it and which can be adjusted for greater rebounding by sliding the bottom net support within a slot. British Patent Number 397,260 does not describe a pitching target device with a strike zone that can be adjusted in width depending on the differences in league rules nor do they describe a device for measuring the distance from the pitching target to the pitcher's mound. Neither does British Patent Number 642,980, published on Sep. 13, 1950 which describes an improved rebounding practice wall for lawn tennis and other similar ball games.

None of the above inventions and patents, taken either singularly or in combination, is seen to describe the instant invention as claimed. Thus a pitcher's training aid solving the aforementioned problems is desired.

SUMMARY OF THE INVENTION

The pitcher's training aid is a practice device for baseball pitchers which allows the pitcher to adjust the size and location of the strike zone for varying degrees of difficulty. The pitcher's training aid includes an upright rectangular frame structure consisting of a horizontal base structure, a vertical target support structure, and at least one non-vertical brace member. Two horizontal support members are slidably mounted on the opposing vertical sides of the target support structure thereby defining the boundaries of a strike zone through which a ball may pass. The vertical height of the strike zone can be adjusted by manipulating the positions of the two horizontal support members along the vertical sides of the target support structure. The strike zone has a first net contiguously attached thereto to catch all the baseballs pitched within the strike zone. The pitcher's training aid also includes a second net assembly which allows for adjustment of the width of the strike zone. The second net assembly has two elastic cords with hooks on each end and a net in between the two cords which can be attached to the horizontal support members. The pitcher's training aid includes two net pockets in which the baseball may enter; one that is within the strike zone (the first net) and one that is outside of the strike zone (the second net).

The pitcher's training aid also includes an integrated tape measure to quickly and easily measure and mark the distance from the frame to a practice pitcher's mound. Furthermore, the pitcher's training aid is designed to be collapsible for easy storage and is constructed of sturdy, lightweight galvanized aluminum tubing.

Accordingly, it is a principal object of the invention to provide a device which can allow a softball or baseball pitcher to practice pitching techniques without the aid of another player and can give the pitcher accurate feedback as to her proficiency level.

It is another object of the invention to provide a device which allows the pitcher to vary the size and height of the strike zone and allows the pitcher to measure and mark off the distance from the pitcher's mound to the target in order to simulate various league rules.

It is a further object of the invention to provide a device which will allow a pitcher to adjust the width and height of the strike zone so that she can fine tune her pitching skills.

Still another object of the invention is to provide a device which can be used by players of all ages that is lightweight, yet sturdy and which is easy to set up and collapsible for easy transportation and storage.

It is an object of the invention to provide improved elements and arrangements thereof in a pitcher's training aid for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Referring to FIGS. 1–5, the pitcher's training aid 10 is a practice device for baseball pitchers which allows the pitcher to adjust the size and location of the strike zone for varying degrees of difficulty.

Figure 1:
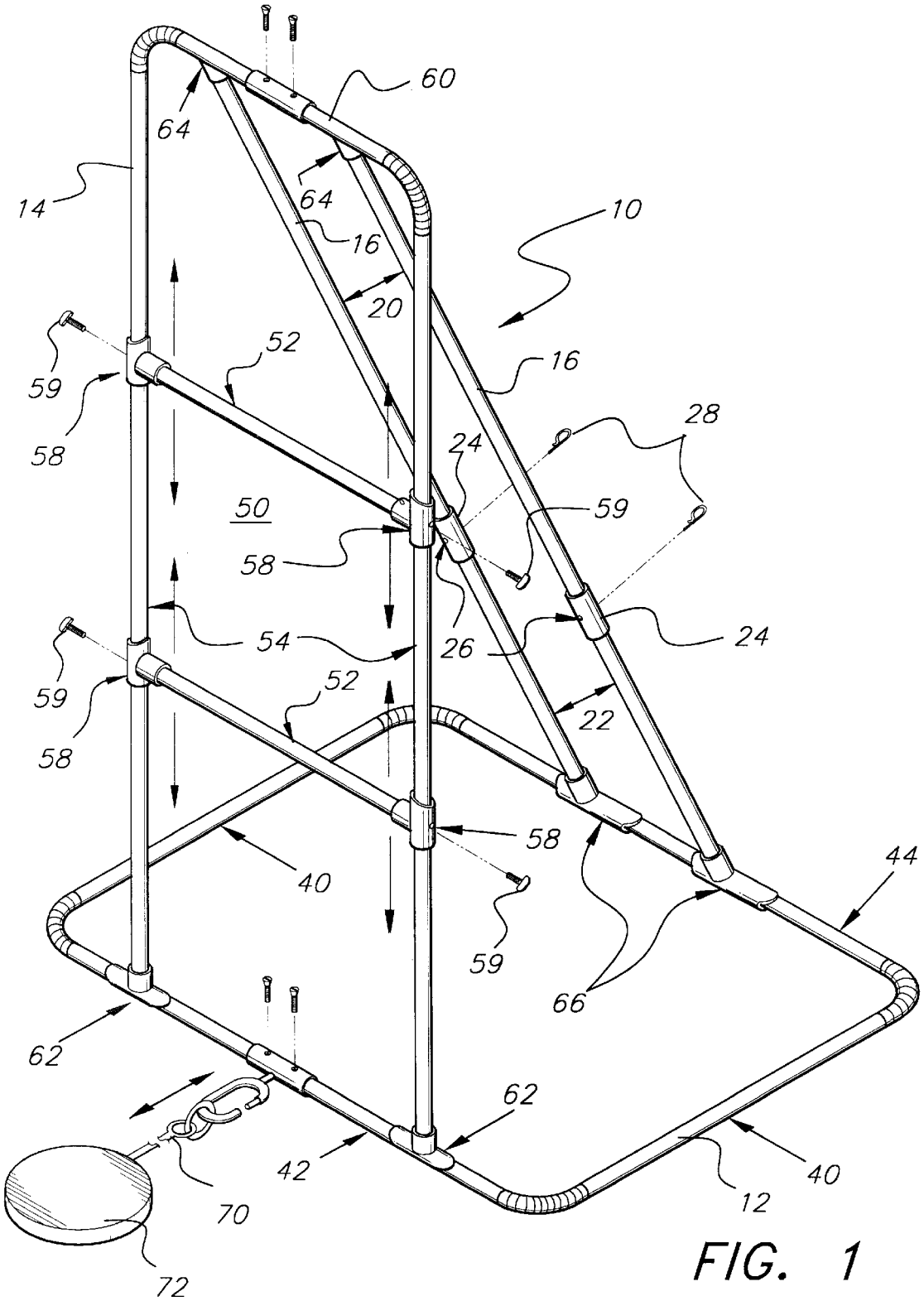
FIG. 1 is an environmental, perspective view of a pitcher's training aid without the two net assemblies showing the adjustability of the horizontal support members according to the first embodiment of the present invention.

As shown in FIG. 1, the first embodiment of the pitcher's training aid 10 includes an upright frame structure consisting of a horizontal base structure 12, a vertical target support structure 14, and two non-vertical brace members 16. The strike zone 50 is defined by two horizontal adjustable support members 52 and the two vertical side members 54 of the target support structure 14 and has a contiguous net 56 affixed thereto.

The vertical target support structure 14 is constructed of two tubular side members 54 and a tubular top member 60. The horizontal base structure is constructed of two tubular side members 40, a front tubular member 42 with integral pivoting joints 62 attached thereto, and a rear tubular member 44 with integral pivoting joints 66 attached thereto. The two non-vertical brace members 16 include two upper tubular members 20 and two lower tubular members 22, the upper and the lower members being joined together by two support couplings 24.

Figure 2:
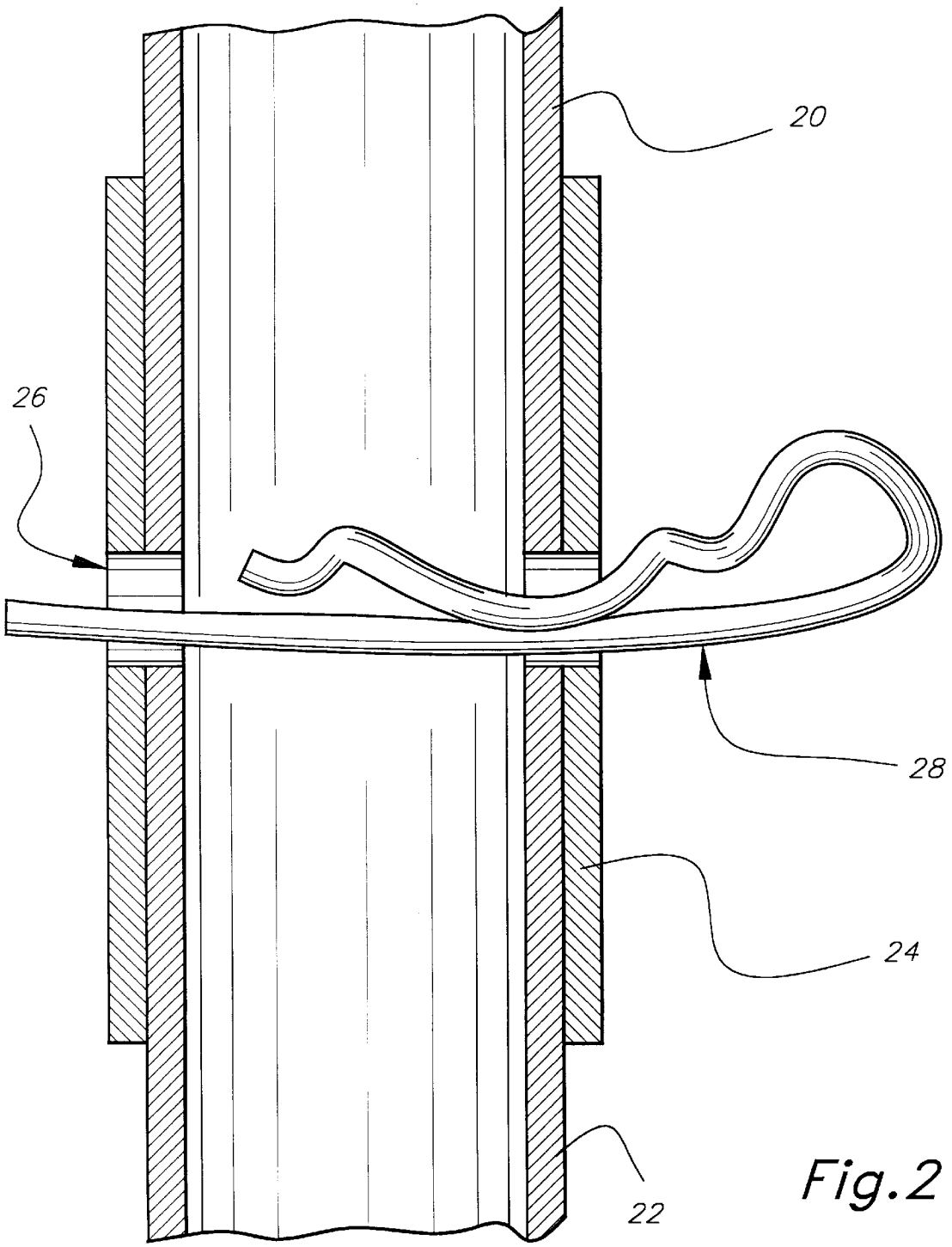
FIG. 2 is a cross-sectional view of one of the coupling joints and pins which connect the upper and lower brace members.

The target support structure 14 is pivotally connected to the base structure 12 by two pivoting joints 62. The target support structure 14 is also pivotally connected to the upper tubular members 20 of the two non-vertical brace members 16 by two pivoting joints 64. The base structure 12 is pivotally connected to the lower tubular members 22 of the two non-vertical brace members by two pivoting joints 66. The entire pitcher's training aid structure 10 can be collapsed into a flat configuration by disengaging the upper brace member 20 from the lower brace member 22 by simply removing the two pins 28 from the holes 26 in the support couplings 24. A detailed view of a support coupling 24 is shown in FIG. 2. The pitcher's training aid 10 can then be folded using the various pivoting joints 62, 64, and 66, thereby making the device easy to transport and store.

As shown in FIG. 1, the pair of horizontal support members 52 are slidably mounted using collars 58 on the opposing vertical sides 54 of the target support structure 14 thereby defining the boundaries of a strike zone 50 through which a ball may pass. The horizontal support members 52 can be slid into position on the vertical sides 54 of the target support structure 14 and locked in position using a wing nut 59. Other devices can be used for locking the support members 52 in position on the vertical sides 54 of the target support structure 14 as long as those devices allow for easy locking and unlocking of the support members 52, for example a spring biased clip (not shown). In an alternative embodiment of the present invention (not shown), the ends of the horizontal support members slide within slots in the vertical sides of the target support structure and are locked in position using wing nuts which are attached to the ends of the support members and extend beyond the outer edge of the target support structure.

The location and size of the strike zone 50 can be varied to conform to the needs and skill level of the pitcher. In the first embodiment, the support members 52 are slidably adjustable on the target support structure 14 between a position six inches above the base structure 12 and a position sixty inches above the base structure 12. The distance between the two support members 52 can be varied thereby manipulating the vertical height of the strike zone 50. Additionally, the vertical position of the strike zone 50 can be adjusted by manipulating the positions of the two horizontal support members 52 along the vertical sides 54 of the target support structure 14.

Figure 3:
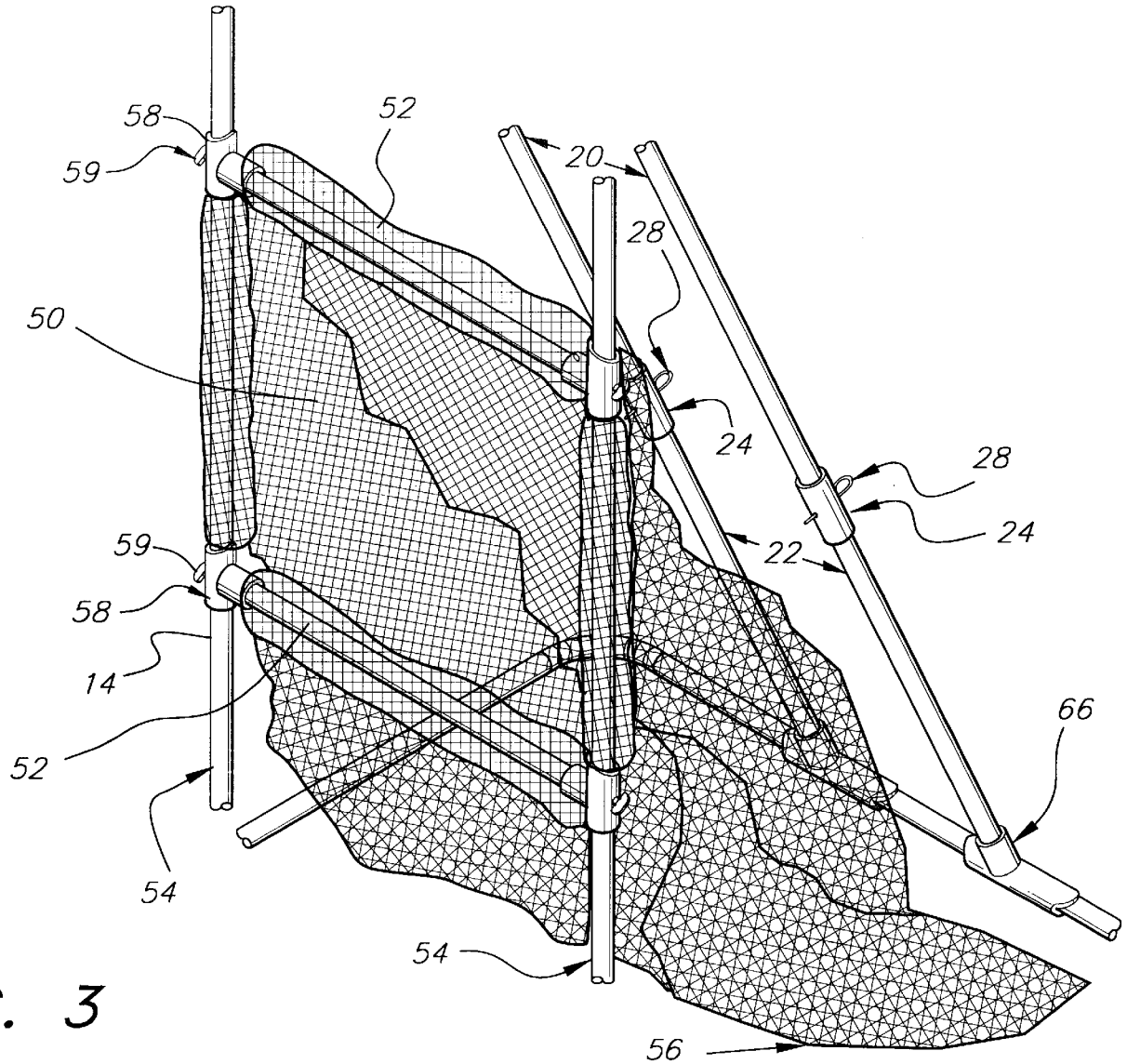
FIG. 3 is an environmental, perspective view of the pitcher's training aid showing the strike zone with the first net assembly.

Referring to FIG. 3, the strike zone 50 has a first net 56 contiguously attached thereto to catch all the baseballs pitched within the strike zone 50. In the first embodiment, the net 56 is attached to the two horizontal support members 52 and the vertical sides 54 of the target support structure 14 by creating a sleeve at the edge of the net 56 and sliding the support members through that sleeve. Alternatively (not shown), the net 56 can be attached by wrapping the edges of the net 56 around the supports and holding the edges in place by weaving a string 30 or other similar device around the supports and through the net 56. In either case, the net 56 should not be firmly held onto the vertical sides 54 of the target support structure 14 which will thereby allow the strike zone 50 and net 56 to be vertically adjusted on the target support structure 14. In a second alternative embodiment (not shown), the net can be attached using a series of rings which are placed around the supports and which hold the edge of the net in position around the strike zone.

Figure 4:
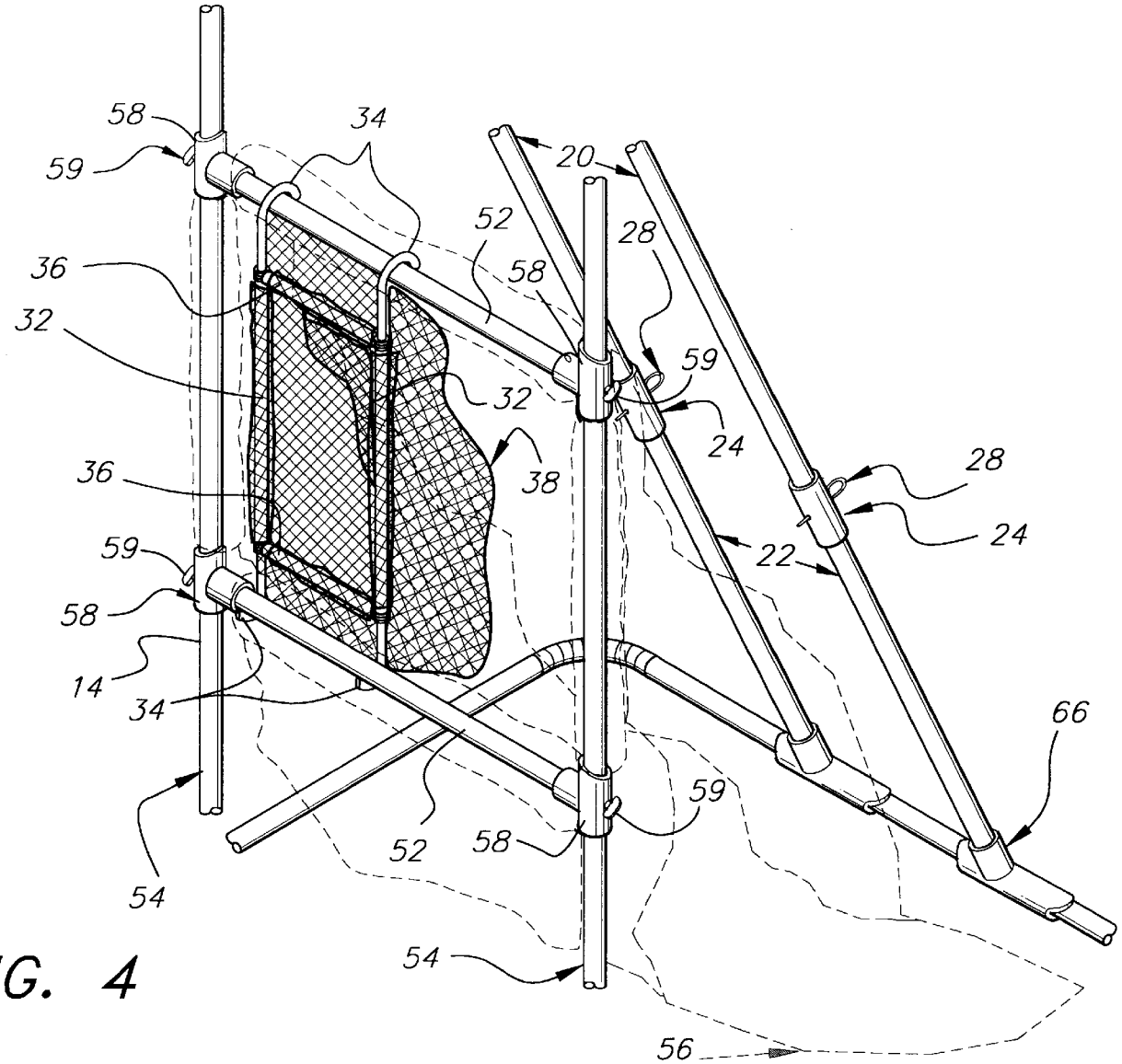
FIG. 4 is an environmental, perspective view of the pitcher's training aid showing the strike zone with the second net assembly.

The pitcher's training aid 10 also includes a second net assembly 31, as shown in FIG. 4, which allows for adjustment of the width of the strike zone. The second net assembly 31 has two elastic cords 32 with hooks 34 on each end, two rigid bars 36 which connect the companion ends of the elastic cords 32, and a net 38 in between the cords. In the first embodiment the second net assembly 31 is constructed of two bungee cords with hooks fastened to the ends of the cords and two steel connecting rods which are welded to the companion hooks on the bungee cords. The net 38 is attached to the elastic cords 32 and the rigid bars 36 in the same manner as the first net 56 is connected to the strike zone 50. It should be noted that the attachment of the net 38 to the elastic cords 32 should allow for the cords 32 to be stretched vertically. In the first embodiment the elastic cords 32 have a relaxed length of twelve inches and a maximum stretch length of thirty-six inches. Preferably the hooks 34 would all face in the same direction, i.e., in the same direction as shown at the top of FIG. 4, to minimize the possibility that the hooks would become dislodged from the cross bar support members 52, 52, when the net is struck with a ball. However, the hooks could be made with a long enough curve so that this would not occur. In any event, both dispositions of hooks 34 are shown only to indicate that either or both are to be considered as being within the scope of the instant invention.

The second net assembly 31 is preferably half the width of the strike zone 50 although various sizes of second net assemblies can be manufactured. To use the second net assembly 31 the pitcher simply sets the strike zone 50 accordingly by adjusting the horizontal support members 52 and then hooking the hooks 34 of the second net assembly 31 over the horizontal support members 52 and positioning the second net assembly to cover the part of the strike zone 50 which is not being used for practice. The pitcher's training aid 10 thereby includes two net pockets in which the baseball may enter; one that is within the strike zone (the first net 56) and one that is outside of the strike zone (the second net 38).

Referring to FIG. 1, the pitcher's training aid 10 also includes an integrated tape measure 70 to quickly and easily measure the distance from the pitcher's training aid 10 to a practice pitcher's mound in order to practice throwing pitches from the distance established in the relevant league rules. The tape measure 70 is connected to the base structure 12 and extends to a distance of one hundred feet. The tape measure 70 also includes a pitcher's reference marker 72 that marks the position of the pitcher's mound. The pitcher's reference marker 72 can be either a circular disc or a rectangular marker (not shown) similar to those typically used to mark the pitcher's mound on baseball and softball diamonds.

The pitcher's training aid 10 is designed for both indoor and outdoor use. The pitcher's training aid 10 is designed to be free standing structure which is collapsible for easy transportation and storage. The frame structure, consisting of a horizontal base structure 12, a vertical target support structure 14, and two non-vertical brace members 16, is constructed of sturdy, lightweight galvanized aluminum tubing. Alternatively, the pitcher's training aid 10 can be constructed of wood or other suitable rigid material.

Figure 5:
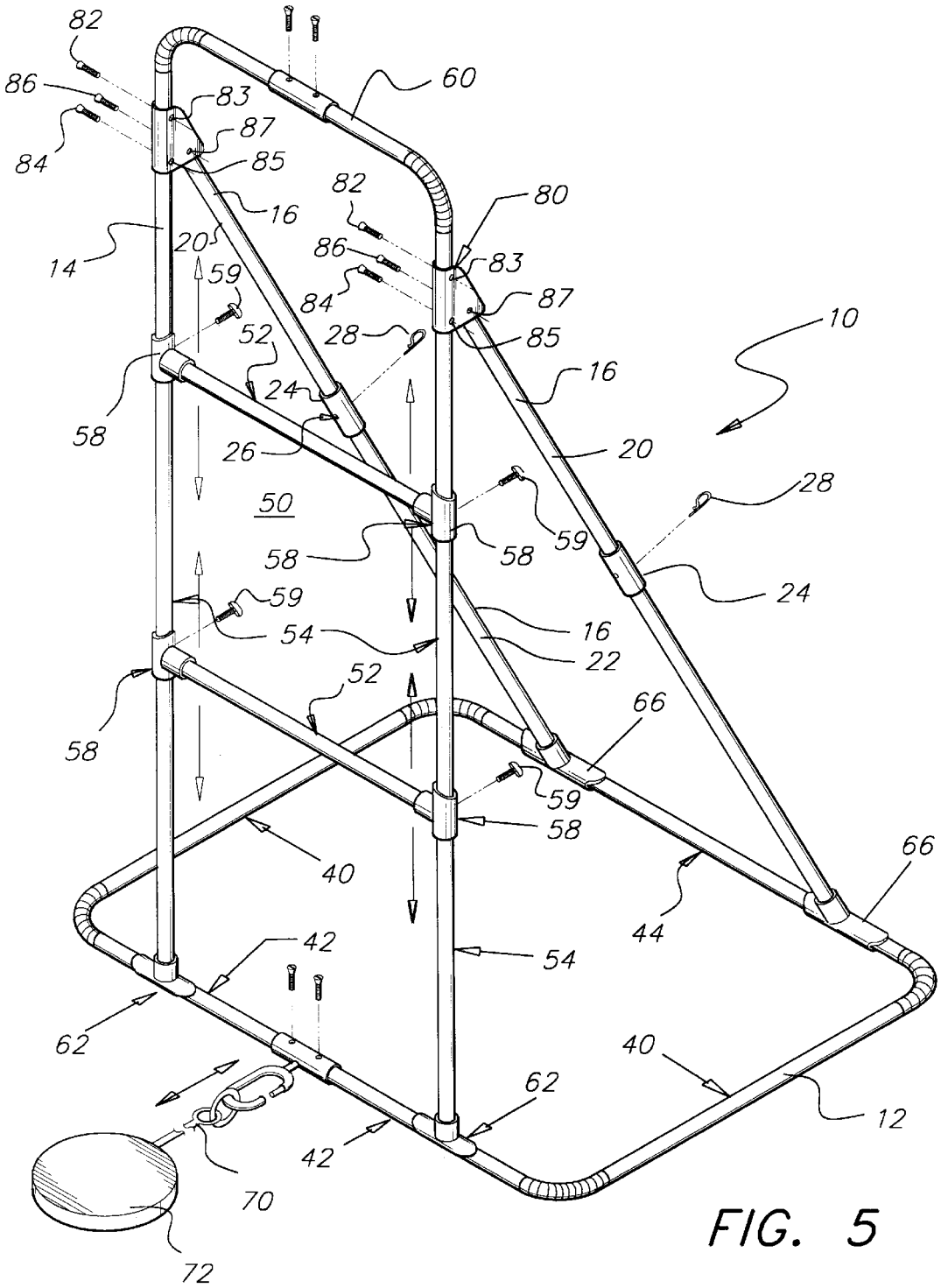
FIG. 5 is an environmental, perspective view of the preferred embodiment of the pitcher's training aid without the two net assemblies showing the orientation and connection of the two non-vertical brace members.

The preferred embodiment of the present invention is shown in FIG. 5. The preferred embodiment of the present invention is identical to the embodiment shown in FIG. 1, except for two structural differences. The first difference is that the wing nuts 59 used for locking the support members 52 in position on the vertical sides 54 of the target support structure 14 have been repositioned on the back side of the collars 58. In this position, the wing nuts 59 minimize the risk of damage to the wing nuts or the ball by a ball thrown at the pitcher's training aid 10. The second difference is that the two non-vertical brace members are aligned with the vertical sides 54 of the target support structure 14 and bracket 64 (from FIG. 1) is replaced with bracket 80.

In the preferred embodiment the vertical sides 54 of the target support structure 14 are pivotally connected to the upper tubular members 20 of the two non-vertical brace members 16 by two joints 80. The joints 80 are fixedly attached to the vertical sides 54 by two screws, 82 and 84, which extend through holes, 83 and 85 respectively. The joints 80 are pivotally attached to the upper tubular members 20 by a screw 86 which extends through hole 87. The upper tubular members 20 are able to pivot about the screw 86 so that the entire pitcher's training aid structure 10 can be collapsed into a flat configuration in the same manner as described for the first embodiment.

It is to be understood that the present invention is not limited to the embodiments described above, but encompasses any and all embodiments within the scope of the following claims.

I claim:

1. A training aid comprising:

a frame including:

a base structure, a target support structure attached to said base structure, and a first brace member attached between said target support structure and said base structure;

a first adjustable support member slidably mounted on said target support structure;

a second adjustable support member slidably mounted on said target support structure;

means for locking said adjustable support members in position upon said target support structure, said adjustable support members and said target support structure thereby defining an opening;

a first net contiguous with said opening and attached to said pair of adjustable support members and said target support structure; and a second net assembly removably attached to said pair of adjustable support members, said second net assembly being within said first net and within said opening.

2. The training aid according to claim 1 wherein said second net assembly includes:

a first cord having a first end and a second end, said first end of said first cord being removably attached to said first adjustable support member, said second end of said first cord being removably attached to said second adjustable support member;

a second cord having a first end and a second end, said first end of said second cord being removably attached to said first adjustable support member, said second end of said second cord being removably attached to said second adjustable support member; and a second net being attached to said first cord and said second cord, and said second net being contiguous with said first cord, said second cord, said first adjustable member, and said second adjustable member.

3. The training aid according to claim 2 wherein said cords are made for an elastic material.

4. The training aid according to claim 2 wherein said second net assembly further includes:

a first rigid rod connecting said first end of said first cord to said first end of said second cord; and a second rigid rod connecting said second end of said first cord and said second end of said second cord.

5. The training aid according to claim 1 wherein said first brace member includes an upper tubular member disengageably coupled with a lower tubular member, said upper member being pivotally connected to said target support structure, said lower member being pivotally connected to said base structure, and said base structure being pivotally connected to said target support structure, whereby said frame is collapsible.

6. The training aid according to claim 1 further comprising a means attached to said frame for measuring the distance between said frame and a fixed location away from said frame.

7. The training aid according to claim 6 wherein said means for measuring the distance between said frame and a fixed location away from said frame includes a marking member attached thereto.

8. The training aid according to claim 6 wherein said means for measuring the distance between said frame and a fixed location away from said frame is a tape measure.

9. The training aid according to claim 1 wherein said frame is constructed of galvanized aluminum tubing.

10. The training aid according to claim 1 wherein:

said base structure is constructed of tubular members forming a substantially rectangular-shaped configuration;

said target support structure is constructed of tubular members forming a substantially U-shaped configuration having a first side member and a second side member substantially parallel to said first side member;

said first brace member is attached between said first side member of said target support structure and said base structure; and further including a second brace member attached between said second side member of said target support structure and said base structure.

11. A training aid comprising:

a frame including:

a base structure of a substantially rectangular-shaped configuration, a target support structure of a substantially U-shaped configuration attached to said base structure, said target support structure having two parallel vertical sides, and a first brace member attached between said target support structure and said base structure;

a first horizontal support member and a second horizontal support member each slidably mounted on said vertical sides of said target support structure and having means for locking said horizontal support members in position upon said vertical side of said target support structure, said horizontal support members and said vertical sides of said target support structure thereby defining the boundaries of a strike zone;

a first net contiguous with said strike zone and attached to said horizontal support members and said vertical sides of said target support structure; and a second net assembly having two cords with attachment means on each end of said cords for attaching opposing ends of each of said cords to said horizontal support members, and a second net attached to said cords and contiguous with said area between said cords and said horizontal support members, said second net assembly allowing for adjustment of the width of said strike zone.

12. The training aid according to claim 11 wherein said first brace member comprises an upper tubular member disengageably coupled with a lower tubular member, said upper member being pivotally connected to said target support structure, said lower member being pivotally connected to said base structure, and said base structure being pivotally connected to said target support structure, whereby said frame is collapsible.

13. The training aid according to claim 11 wherein said cords are made for an elastic material.

14. The training aid according to claim 11 wherein said second net assembly further includes two rigid rods, each rod interconnecting one end of each of said cords.

15. The training aid according to claim 11 further comprising a means attached to said frame for measuring the distance between said frame and a fixed location away from said frame.

16. The training aid according to claim 15 wherein said means for measuring the distance between said frame and a fixed location away from said frame includes a marking member attached thereto.

17. The training aid according to claim 15 wherein said means for measuring the distance between said frame and a fixed location away from said frame is a tape measure.

18. The training aid according to claim 11 wherein said horizontal support members are slidably adjustable between a position six inches vertically above said base structure and a position sixty inches vertically above said base structure.

19. The training aid according to claim 11 wherein said frame is constructed of galvanized aluminum tubing.

20. The training aid according to claim 11 wherein:

said base structure is constructed of tubular members;

said target support structure is constructed of tubular members, said target support structure having a first vertical side and a second vertical member substantially parallel to said first vertical side;

said first brace member is attached between said first vertical side of said target support structure and said base structure; and further including a second brace member attached between said second vertical side of said target support structure and said base structure.

* * * * *